US006655953B1

(12) United States Patent
Bengoa

(10) Patent No.: US 6,655,953 B1
(45) Date of Patent: Dec. 2, 2003

(54) DISPOSABLE LIGHTER

(75) Inventor: Carlos Bengoa, Deloit, WI (US)

(73) Assignee: Gladstrong Investments (usa) Corp., Hacienda Heights, CA (US)

( * ) Notice: Subject to any disclaimer, the term of this patent is extended or adjusted under 35 U.S.C. 154(b) by 0 days.

(21) Appl. No.: 10/314,371

(22) Filed: Dec. 9, 2002

(51) Int. Cl.[7] ..... F23D 11/36; F23Q 7/12
(52) U.S. Cl. ..... 431/153; 431/255
(58) Field of Search ..... 431/153, 255, 431/132, 277, 354

(56) References Cited

U.S. PATENT DOCUMENTS 2,168,732 A * 8/1939 Dubsky ..... 431/276
6,099,300 A * 8/2000 Rice ..... 431/255
D470,268 S * 2/2003 Berry
2002/0102506 A1 * 8/2002 Berry et al.

* cited by examiner

*Primary Examiner*—Alfred Basichas
(74) *Attorney, Agent, or Firm*—Raymond Y. Chan; David and Raymond Patent Group

(57) ABSTRACT

A disposable lighter includes a gas casing receiving a fuel storage, a gas emitting nozzle communicating with the fuel storage for controlling a flow of gas, an outer shelter slidably mounted on a sidewall of the gas casing, a piezoelectric unit supported between the gas casing and the outer shelter, and an actuating arm extended from an inner side of the outer shelter to a top end of the piezoelectric unit in such a manner that when the outer shelter is axially slid with respect to the gas casing, the actuating arm is driven to compress the piezoelectric unit so as to ignite the disposable lighter.

9 Claims, 8 Drawing Sheets

DISPOSABLE LIGHTER

BACKGROUND OF THE PRESENT INVENTION

1. Field of Invention

The present invention relates to a lighter, and more particularly to a disposable lighter, which comprises a gas casing and an outer shelter slidably mounted on a side of the gas casing wherein the outer shelter functions as an ignition actuator and arranged in such a manner that the outer shelter is slid in an axially movable manner with respect to the gas casing to ignite the disposable lighter.

2. Description of Related Arts

A conventional piezoelectric lighter generally comprises a lighter case receiving a fuel storage chamber and having an ignition cavity, an ignition system comprises a gas emitting nozzle communicated with the fuel storage chamber, a piezoelectric unit disposed in the ignition cavity and arranged for producing a spark toward the gas emitting nozzle, and an ignition button slidably mounted on top of the lighter case and communicated with the gas emitting nozzle via a gas lever.

Hence, when the ignition button is depressed downwardly, the gas lever is arranged to lift up the gas emitting nozzle for releasing gas fuel and, at the same time, a movable operating part of the piezoelectric unit is depressed downwardly to produce the spark at the ignition tip of the gas emitting nozzle such that the gas fuel ejecting from the gas emitting nozzle is then ignited by the spark.

According to the construction of the conventional piezoelectric lighter, the ignition button is provided on a top side of the lighter case adjacent to the ignition tip of the gas emitting nozzle such that a user must use his or her thumb to depress the ignition button downwardly to ignite the piezoelectric lighter. One of the reasons for such structure is that the user is able to conveniently ignite the piezoelectric lighter.

However, such convenient structure also creates some repercussions. The conventional piezoelectric lighter may cause undesirable ignitions, especially by children.

As a matter of facts, the appearances and the operation procedures of most conventional piezoelectric lighters are similar. Driven by curiosity, a child may easily recognize that there is a lighter in a certain place and he or she can easily reach and ignite it for fun. Although safety locks are incorporated with such piezoelectric lighters to lock up the downward movement of the ignition button, most of the safety locks are simple enough that the children can easily figure out the way to unlock the ignition button.

Moreover, since the ignition button is positioned adjacent to the ignition tip of the gas emitting nozzle, the flame produced at the ignition tip of the gas emitting nozzle may bum the user's thumb, especially when the flame is adjusted to have a larger flame size. For example, when the user ignites the piezoelectric lighter to light up a cigar that takes a relative longer time, the flame will heat up the surrounding area of the ignition tip of the gas emitting nozzle. Therefore, the flame may burn a portion of the ignition button closed to the ignition tip or even hurt the user's thumb.

In addition, the size of the lighter case must be large enough to store the gas therein and receive the piezoelectric unit. In order to provide a compact size of the piezoelectric lighter, the size of the fuel storage chamber in the lighter case must be minimized to create the ignition cavity for the piezoelectric unit disposed therein. Therefore, most of the piezoelectric lighter must be disposed when the gas fuel is used up rather than the piezoelectric unit is terminated.

Besides, since the ignition button is conventionally constructed on the top side of the lighter case, the ignition button will limit the appearance of the piezoelectric lighter. Such press down type of the piezoelectric lighter also prevents the industry designer to create any ornament design without the ignition button equipped thereon.

SUMMARY OF THE PRESENT INVENTION

A main object of the present invention is to provide a disposable lighter which comprises a gas casing and an outer shelter slidably mounted on a side of the gas casing wherein the outer shelter functions as an ignition actuator and arranged in such a manner that the outer shelter is slid in an axially movable manner with respect to the gas casing to ignite the disposable lighter.

Another object of the present invention is to provide a disposable lighter, wherein no ignition button is mounted on the gas casing so that the children may not find out how to operate the disposable lighter so as to prevent the disposable lighter from being ignited by the children.

Another object of the present invention is to provide a disposable lighter, wherein the piezoelectric unit is mounted between the gas casing and the outer shelter such that the size of the gas chamber in the gas casing can be maximized to prolong the service life of the present invention.

Another object of the present invention is to provide a disposable lighter, wherein an adult must use his or her fingers to apply the axial sliding force on the outer shelter, such that the adult's fingers are positioned below the ignition tip of the gas emitting nozzle so as to prevent the adult's fingers getting burnt by the flame. In other words, the adult's fingers are positioned far away from the flame for safety purpose.

Another object of the present invention is to provide a disposable lighter, wherein the disposable lighter can be designed and crafted to a variety of shapes and models without affecting the ignition operation of the disposable lighter, so as to enhance the aesthetic appearance of the disposable lighter of the present invention.

Another object of the present invention is to provide a disposable lighter, wherein the ignition operation of the disposable lighter merely requires a simple single-action operation by the adult instead of the conventional double-action operation.

Another object of the present invention is to provide a disposable lighter, which comprises a compression resistance element provided between the outer shelter and the gas casing for providing an additional sliding resistance force against the outer shelter such that the compression resistance element forms as a physical barrier for preventing the disposable lighter of the prevent invention from being ignited accidentally or by children.

Another object of the present invention is to provide a disposable lighter, wherein no expensive or complicated mechanism is required to employ in the disposable lighter, so as to minimize the manufacturing and marketing cost of the disposable lighter of the present invention.

Accordingly, in order to accomplish the above objects, the present invention provides a disposable lighter, comprising:

a gas casing receiving a fuel storage;

a gas emitting nozzle having an ignition tip appearing at a ceiling of the gas casing and communicating with the fuel storage for controlling a flow of gas;

a piezoelectric unit comprising a main piezoelectric body, a movable operating part slidably extended therefrom, and a spark generating tip extended to a position close to the ignition tip of the gas emitting nozzle, wherein when the movable operating part is depressed with respect to the main piezoelectric body, the spark generating tip generates sparks to ignite the gas emitted from the ignition tip of the gas emitting nozzle;

an outer shelter slidably mounted on a sidewall of the gas casing and defining a receiving cavity between the outer shelter and the gas casing wherein the piezoelectric unit is received in the receiving cavity; and an actuating arm extended from an inner side of the outer shelter to a top end of the piezoelectric unit in such a manner that when the outer shelter is axially slid with respect to the gas casing, the actuating arm is driven to compress the piezoelectric unit so as to ignite the disposable lighter.

DETAILED DESCRIPTION OF THE PREFERRED EMBODIMENT

Figure 1:
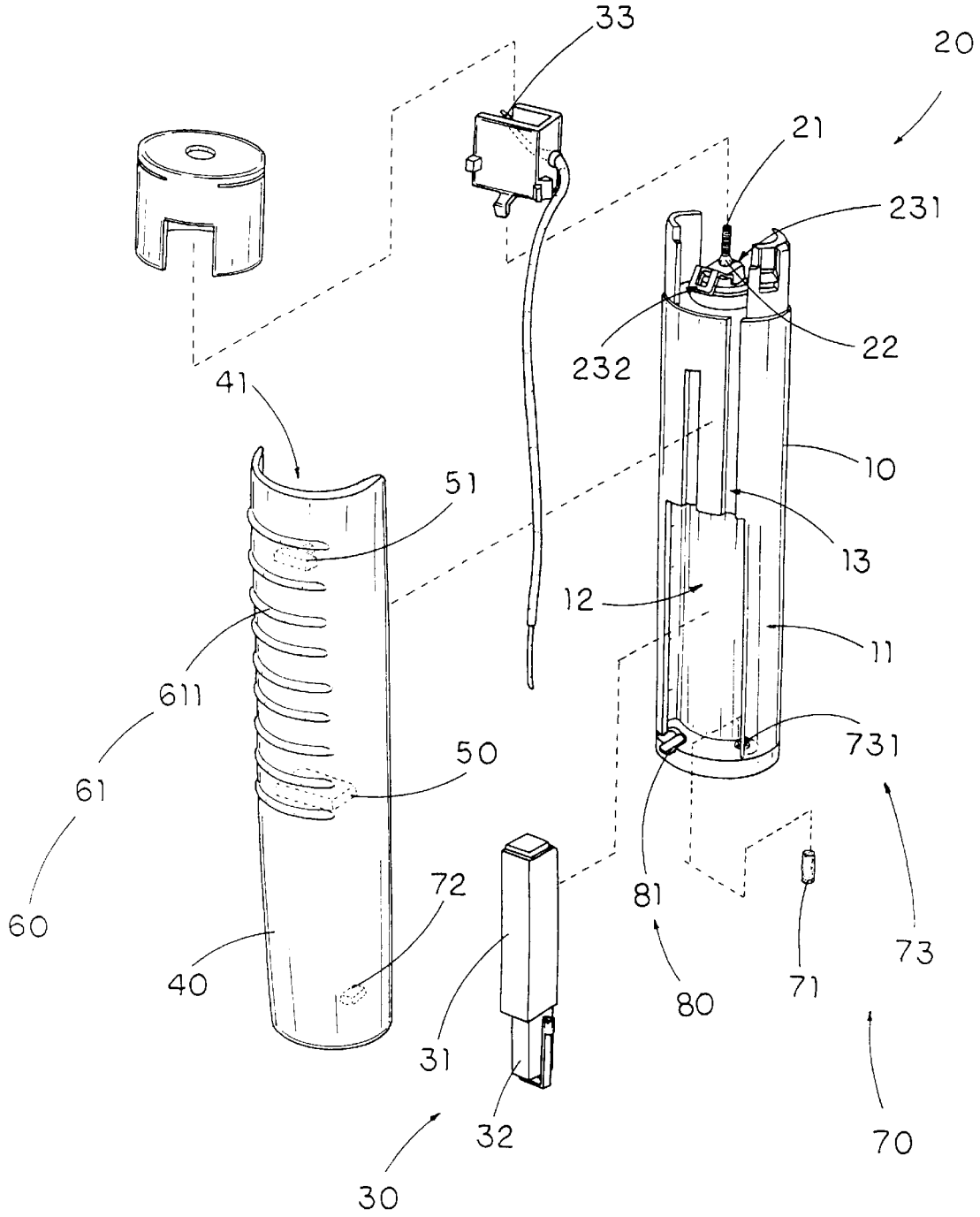
FIG. 1 is an exploded perspective view of a disposable lighter according to a first preferred embodiment of the present invention.

Referring to FIG. 1 of the drawings, a disposable lighter according to a first preferred embodiment of the present invention is illustrated, wherein the disposable lighter comprises a gas casing 10 receiving a fuel storage 11, a gas emitting nozzle 20 having an ignition tip 21 appearing at a ceiling of the gas casing 10 and communicating with the fuel storage 11 for controlling a flow of gas.

The disposable lighter further comprises a piezoelectric unit 30, an outer shelter 40 and an actuating arm 50.

The piezoelectric unit 30 comprises a main piezoelectric body 31, a movable operating part 32 slidably extended therefrom, and a spark generating tip 33 extended to a position close to the ignition tip 21 of the gas emitting nozzle 20, wherein when the movable operating part 32 is depressed with respect to the main piezoelectric body 31, the spark generating tip 33 generates sparks to ignite the gas emitted from the ignition tip 21 of the gas emitting nozzle 20.

The outer shelter 40 is slidably mounted on a sidewall of the gas casing 10 in an axially movable manner and defines a receiving cavity 41 between the outer shelter 40 and the gas casing 10 wherein the piezoelectric unit 30 is received in the receiving cavity 41.

The actuating arm 50 is extended from an inner side of the outer shelter 40 to a top end of the piezoelectric unit 30 in such a manner that when the outer shelter 40 is axially slid with respect to the gas casing 10, the actuating arm 50 is driven to compress the piezoelectric unit 30 so as to ignite the disposable lighter.

Figure 2A:
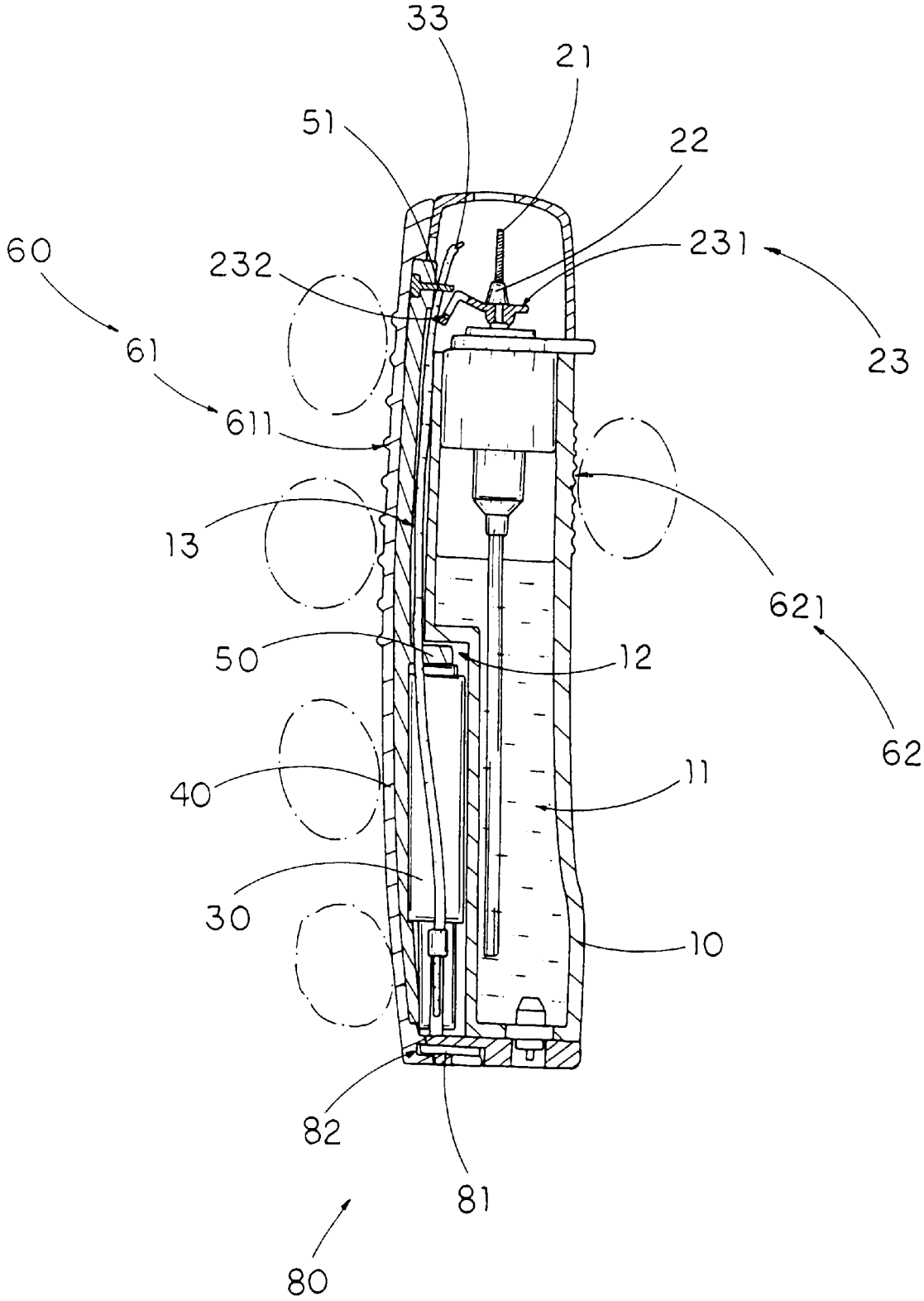
FIG. 2A is a sectional view of the disposable lighter according to the above first preferred embodiment of the present invention.

As shown in FIG. 2A, the gas emitting nozzle 20 is communicated with the fuel storage 11 via a gas releasable valve 22 for controlling the flow of gas, wherein the gas releasable valve 22 is adapted to be lifted up via a gas lever 23 for releasing the gas in the fuel storage cavity 11 through the ignition tip 21 of the gas emitting nozzle 20.

The gas lever 23 has an engaging end 231 engaging with the gas releasable valve 22 and an actuating end 232 arranged in such a manner that when the actuating end 232 of the gas lever 23 is depressed downwardly, the engaging end 231 of the gas lever 23 pivotally lifts up the gas releasable valve 22 to release the gas from the fuel storage 11.

As shown in FIG. 1, the gas emitting nozzle 20 is sealedly mounted on the gas casing 10 to form a one-piece integral body. Since the piezoelectric unit 30 is positioned outside of the gas casing 10 instead of the conventional lighter that the piezoelectric unit is disposed inside the gas casing, the size of the fuel storage 11 can be maximized to store the gas fuel therein.

The gas casing 10 further has a receiving chamber 12 formed on the sidewall of the gas casing 10 and a guiding slot 13 which is indented on the sidewall of the gas casing and extended from the receiving chamber 12 to the ceiling of the gas casing 10 wherein the piezoelectric unit 30 is disposed in the receiving chamber 12 and the spark generating tip 33 is guided towards extend to the ignition tip 21 of the gas emitting nozzle 20 through the guiding slot 13.

According to the first embodiment, the outer shelter 40 is shaped and sized as a sidewall shelter to fully cover the sidewall of the gas casing 10 in a slidably movable manner so as to enclose the receiving chamber 12 of the gas casing 10 and retain the piezoelectric unit 30 in position, wherein the outer shelter 40 is adapted to be axially and downwardly slid on the sidewall of the gas casing 10.

Figure 2B:
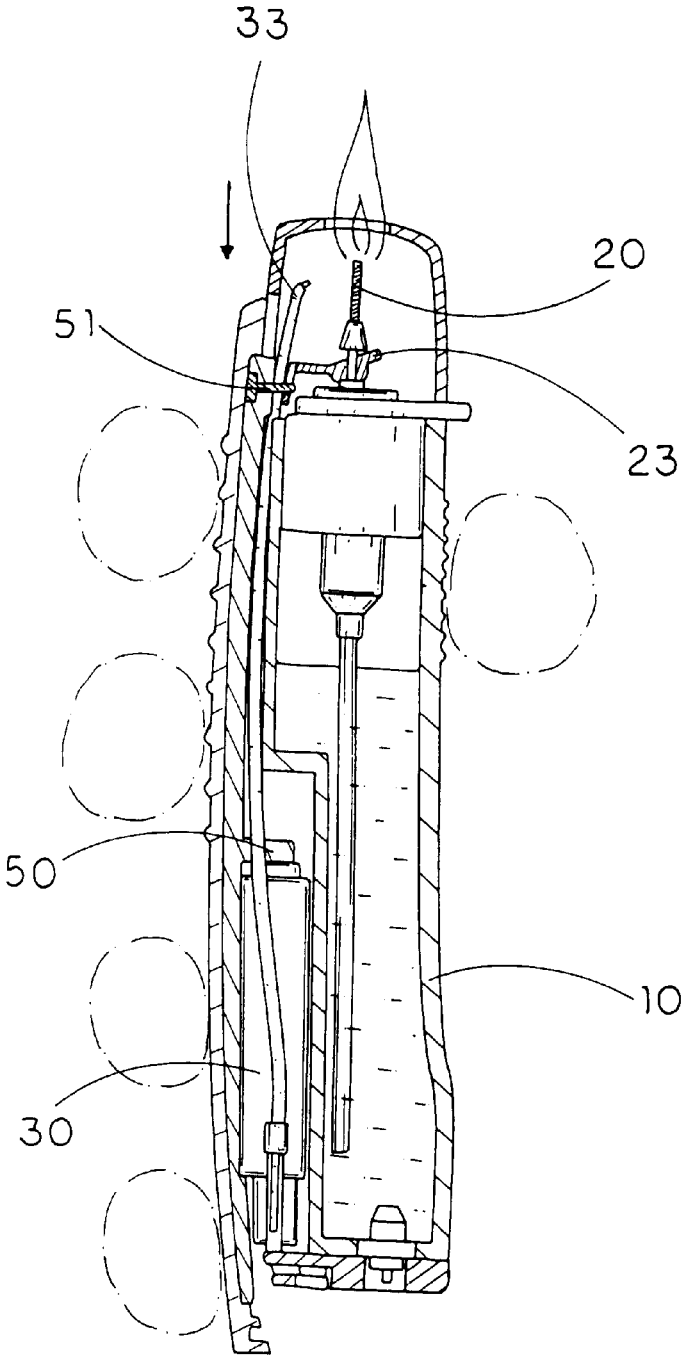
FIG. 2B is a sectional view of the disposable lighter according to the above first preferred embodiment of the present invention, illustrating the disposable lighter being ignited.

The actuating arm 50 is supported in the receiving cavity 41 wherein the actuating arm 50 is extended from the inner side of the outer shelter 40 to the top end of the main piezoelectric body 31 of the piezoelectric unit 30 in such a manner that when the outer shelter 40 is downwardly slid on the gas casing 10, the actuating arm 50 is driven downwardly to compress the piezoelectric unit 30 so as to ignite the disposable lighter, as shown in FIG. 2B.

The disposable lighter of the present invention further comprises a depressible arm 51 extended from the inner side of the outer shelter 40 to engage with the actuating end 232 of the gas lever 23 in such a manner that when the outer shelter 40 is downwardly slid on the gas casing 10 to compress the piezoelectric unit, the depressible arm 51 is driven to depress the actuating end 232 of the gas lever 23, so as to lift up the gas releasable valve 22 for releasing the gas from the fuel storage 11.

As shown in FIGS. 2A and 2B, the disposable lighter further, comprises an ignition guiding arrangement 60 which comprises a first guider 61 provided on an outer side of the outer shelter 40 and a second guider 62 provide on an upper portion of an opposed sidewall of the gas casing 10 wherein the first and second guiders 61, 62 provide finger grips for frictionally contacting the user's thumb and fingers on the gas casing 10 and the outer shelter 40 respectively.

Accordingly, the first guider 61 comprises a plurality of gripping ribs 611 integrally protruded from the outer side of the outer shelter 40 and the second guider 62 comprises a plurality of projections 621 protruded from the opposed sidewall of the gas casing 10 in such a manner that the user is able to securely hold the disposable lighter and slide the outer shelter 40 on the gas casing 10 by pressing the user's thumb on the projections 621 of the second guider 62 and the user's fingers on the gripping ribs 611 of the first guider 61. In other words, the ignition guiding arrangement 60 enhance the friction between the disposable lighter and the user's hand so that the user can easily slide down the outer shelter 40 with respect to the gas casing 10.

Figure 4:
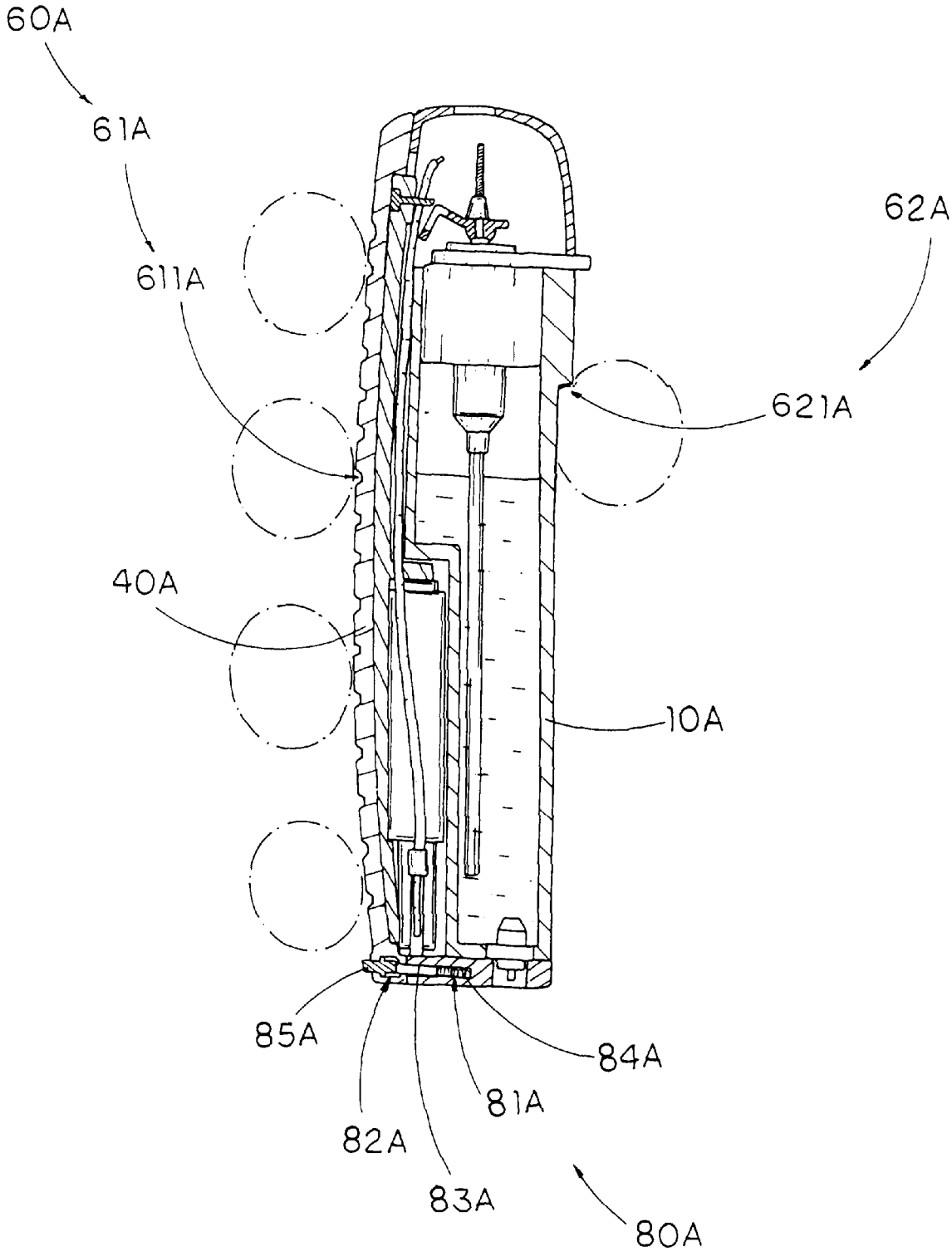
FIG. 4 illustrates an alternative mode of a gas casing of the disposable lighter according to the above first preferred embodiment of the present invention.

Alternatively, the first guider 61A comprises a plurality of guiding grooves 611A indented on the outer side of the outer shelter 40 and the second guider 62A is embodied as a guiding edge 621A integrally protruded from the opposed sidewall of the gas casing 10A such that the user's thumb is adapted to press at the guiding edge 621A of the second guider 62A and the user's fingers are pressed on the guiding grooves 611 A of the first guider 61A on the outer shelter 40 so as to frictionally slide the outer shelter 40 on the gas casing 10A by the user's hand, as shown in FIG. 4.

It is worth mentioning that the user must use his or her thumb and fingers to ignite the disposable lighter. Therefore, only the adult user is able to ignite the disposable lighter since he or she has a bigger hand that the user's thumb presses on the gas casing 10 and the user's fingers press on the outer shelter 40. However, a young child has a smaller hand size that is unable to hold the disposable lighter to slide the outer shelter 40 on the gas casing 10 for ignition. In other words, the outer shelter 40 functions as a physical barrier to prevent the disposable lighter from being ignited.

Figure 3:
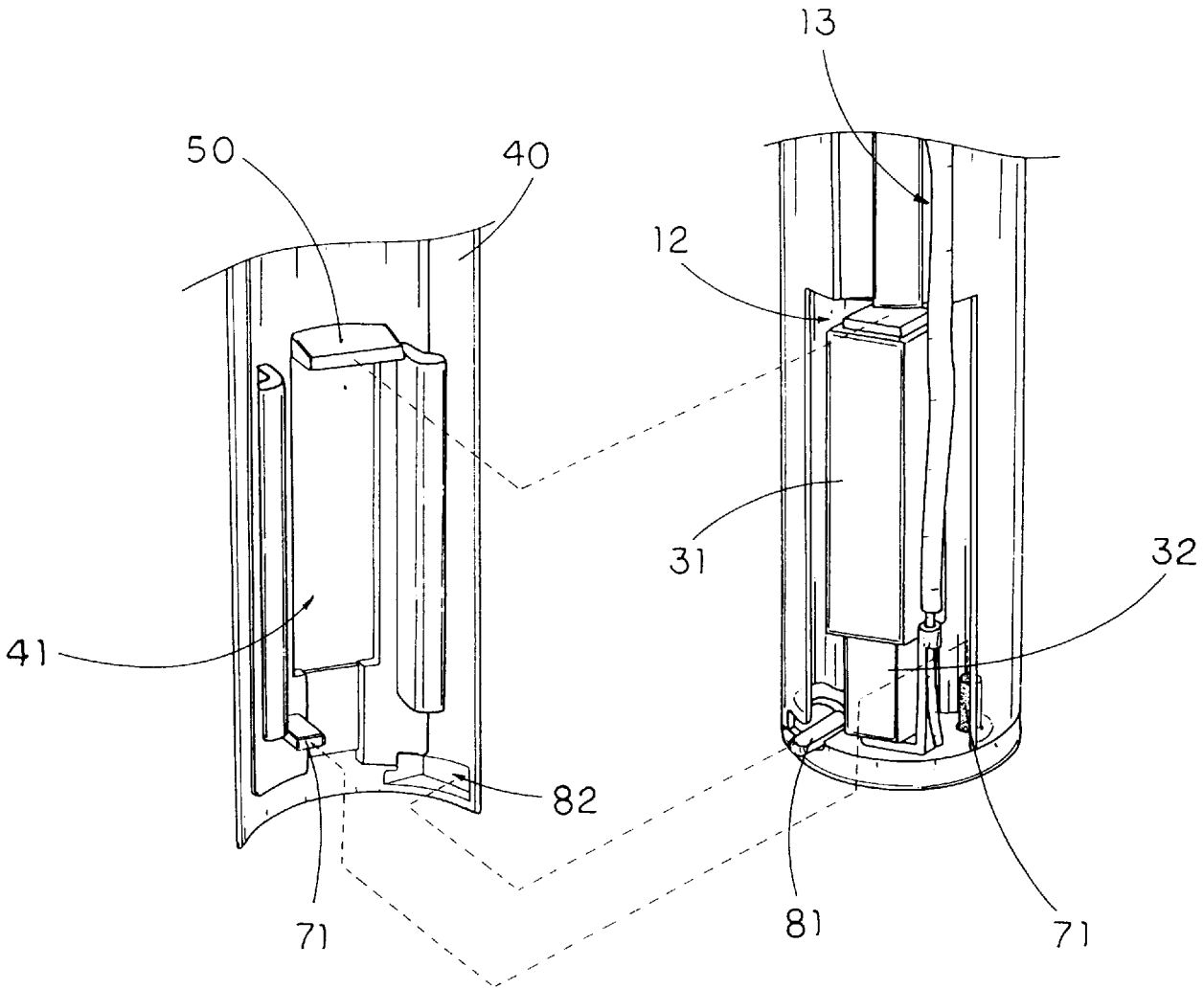
FIG. 3 is a partially enlarged perspective view of the disposable lighter according to the above first preferred embodiment of the present invention.

For safety purpose, the disposable lighter further comprises a pressure absorbing arrangement 70 which comprises a compression resistance element 71 supported in the receiving cavity 41 for providing a sliding resistance against the outer shelter 40 and a pusher arm 72 extended from the inner side of the outer shelter 40 to a top end of the compression resistance element 71 wherein the sliding resistance is an additional upward force added to the outer shelter 40 in addition to that provided by the piezoelectric unit 30, as shown in FIG. 3. In other words, the compression resistance element 71 must be compressed by the pusher arm 72 when the outer shelter 40 is slid on the gas casing 10 to ignite the disposable lighter. Therefore, the pressure absorbing arrangement 70 can stop the young children from the usage of the disposable lighter by limitation of their physical capability.

Accordingly, the compression resistance element 71 is a cylindrical rubber post vertically held in the receiving chamber 12 of the gas casing 10. The pressure absorbing arrangement 70 further comprises means 73 for securely holding the compression resistance element 71 in the receiving cavity 41 wherein the holding means 73 has an indention 731 provided on a bottom wall of the receiving chamber 12 in such a manner that a bottom end of the compression resistance element 71 is securely received in the indention 731 so as to vertically support the compression resistance element 71 in the receiving cavity 41, as shown in FIG. 3.

Moreover, the disposable lighter further comprises a safety locking arrangement 80 for locking a sliding movement of the outer shelter 40 on the gas casing 10, wherein the safety locking arrangement 80 has a locking groove 81 transversely formed on the inner side of the outer shelter 40 and comprises a locking member 81 having a control end rotatably mounted to the gas casing 10 and a locking end adapted to move into the locking groove 81 so as to lock up the outer shelter 40 on the gas casing 10. In other words, when the control end of the locking member 81 is rotated to drive the locking end of the locking member 81 into the locking groove 81, the outer shelter 40 is locked up with respect to the gas casing 10, so as to prevent the disposable lighter from being ignited accidentally and unintentionally.

Alternatively, the safety locking arrangement 80A has a locking groove 81A transversely provided on the sidewall of the gas casing 10A and a locking hole 81A provided on the outer shelter 40A and aligned with the locking groove 81A, wherein the safety locking arrangement 80A further comprises a locking member 83A slidably received in the locking groove 81A, a resilient element 84A disposed in the locking groove 81A for applying an urging force against the locking member 83A to push the locking member 83A towards the locking hole 82A to lock up the outer shelter 40A on the gas casing 10A, and a pusher button 85A slidably mounted on the outer shelter 40A through the locking hole 82A and arranged in such a manner that when the pusher button 85A pushes the locking member 84A into the locking groove 81A, the locking member 84A is moved out of the locking hole 82A to release a blocking up of the outer shelter 40A with respect to the gas casing 10A, so that the outer shelter 40A is capable of axially sliding on the gas casing 10A, as shown in FIG. 4.

In order to ignite the disposable lighter, the user is preferred to use his or her thumb to press on the gas casing 10 at the second guider 62 and his or her fingers to press on the outer shelter 61 at the first guider 61 such that by applying a downward sliding force on the outer shelter 40, the outer shelter 40 is axially slid on the gas casing 10 to compress the piezoelectric unit 30 by the actuating arm 50 so as to ignite the disposable lighter.

By releasing the downward sliding force on the outer shelter 40, the compressed piezoelectric unit 30 is rebounded to its original form so as to push the outer shelter 40 upwardly via the actuating arm 50 back to the original position. Since the ignition operation of the disposable lighter requires the user to hold the outer shelter 40 and the gas casing 10, the flame at the ignition tip 21 of the gas emitting nozzle 20 is positioned above the user's hand. Therefore, the user's hand will not be burnt by the flame even the disposable lighter is remained in its ignition position for a period of time.

Figure 5:
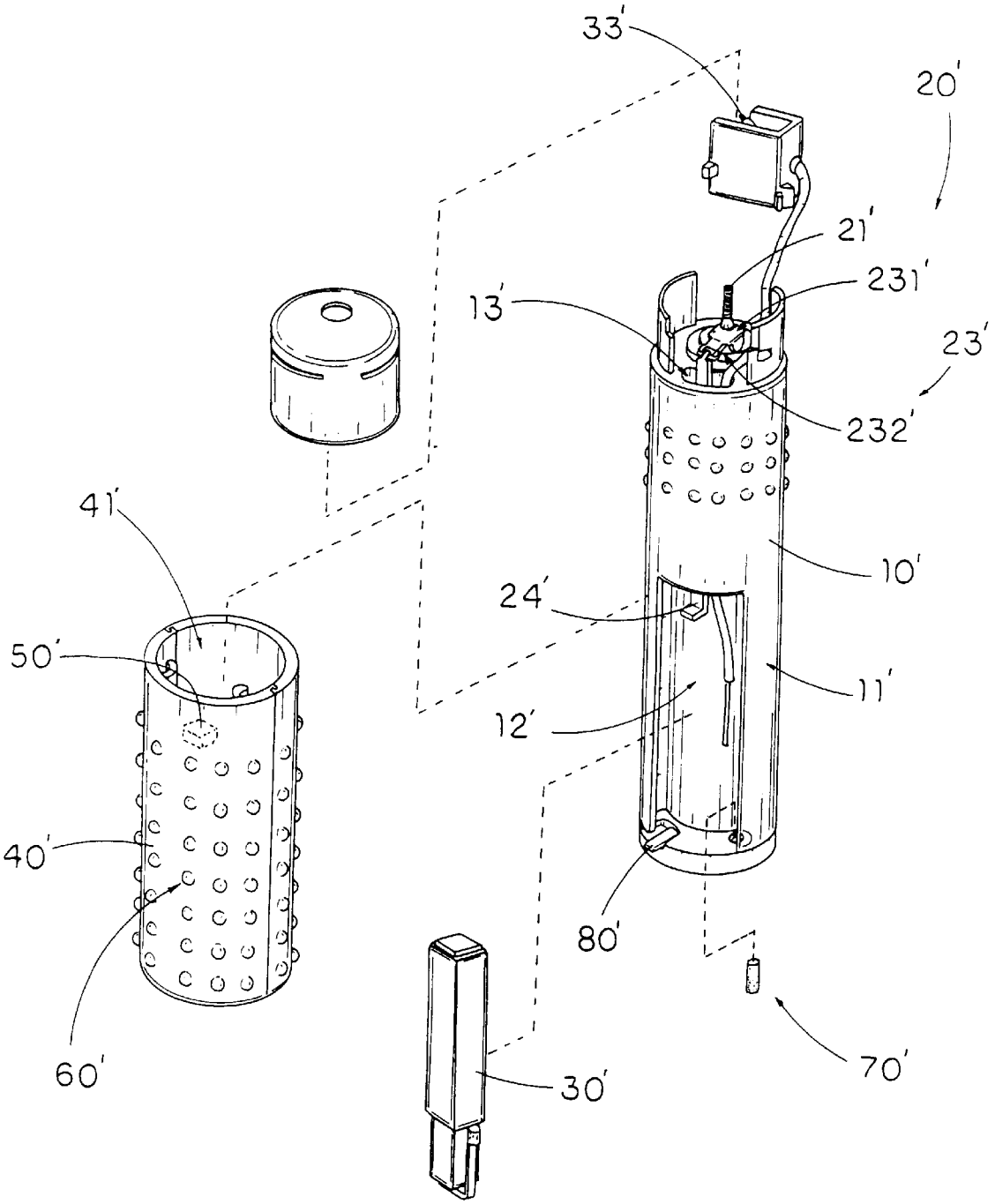
FIG. 5 is an exploded perspective view of a disposable lighter according to a second preferred embodiment of the present invention.
Figure 6:
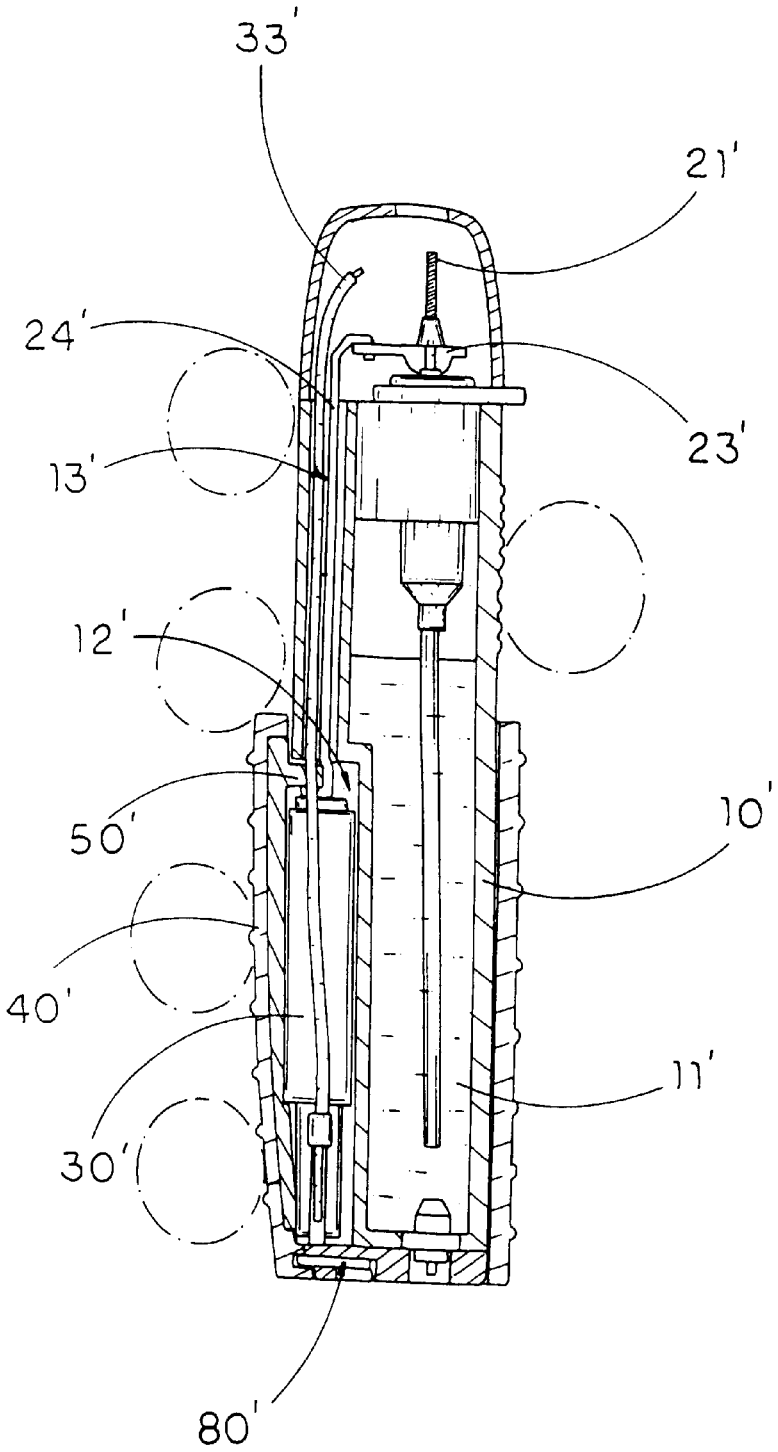
FIG. 6 is a sectional view of the disposable lighter according to the above second preferred embodiment of the present invention.

As shown in FIGS. 5 and 6, a disposable lighter of a second embodiment illustrates an alternative mode of the first embodiment of the present invention, wherein the gas casing 10' has a receiving chamber 12' provided on a lower portion of the sidewall of the gas casing 10' and a through slot 14' extended from the receiving chamber 12' to a ceiling of the gas casing 10'.

According to the second embodiment, the piezoelectric unit 30' is disposed in the receiving chamber 12' within the receiving cavity 41' wherein the spark generating tip 33' is extended from the piezoelectric unit 30' to a position close to the ignition tip 21' of the gas emitting nozzle 20' through the through slot 14'.

The outer shelter 40' is constructed as a tubular sleeve having a shape and size encirclingly mounted on a lower portion of the sidewall of the gas casing 10' in an axially and slidably movable manner, so as to enclose the receiving chamber 12' of the gas casing 10'. The actuating arm 50' is extended from the inner side of the outer shelter 40' to the top end of the piezoelectric unit 30' in such a manner that when the outer shelter 40' is downwardly and axially slid on the gas casing 10', the actuating arm 50' is driven to compress the piezoelectric unit 30' so as to ignite the disposable lighter.

The gas emitting nozzle 20' further comprises a driven arm 24' having a pulling end engaged with the actuating end 232' of the gas lever 23' and a driven end extended through the through slot 14' to engage with the actuating arm 50' in such a manner that when the outer shelter 40' is axially slid on the gas casing 10', the actuating arm 50' is driven downwardly to lift up the engaging end 231' of the gas lever 23' for releasing the gas from the fuel storage 11'.

Moreover, ignition guiding arrangement 60', the pressure absorbing arrangement 70', and the safety locking arrangement 80' according to the first embodiment is adapted to incorporate in the disposable lighter of the second embodiment to provide the safety feature of the present invention, as shown in FIG. 5.

Figure 7:
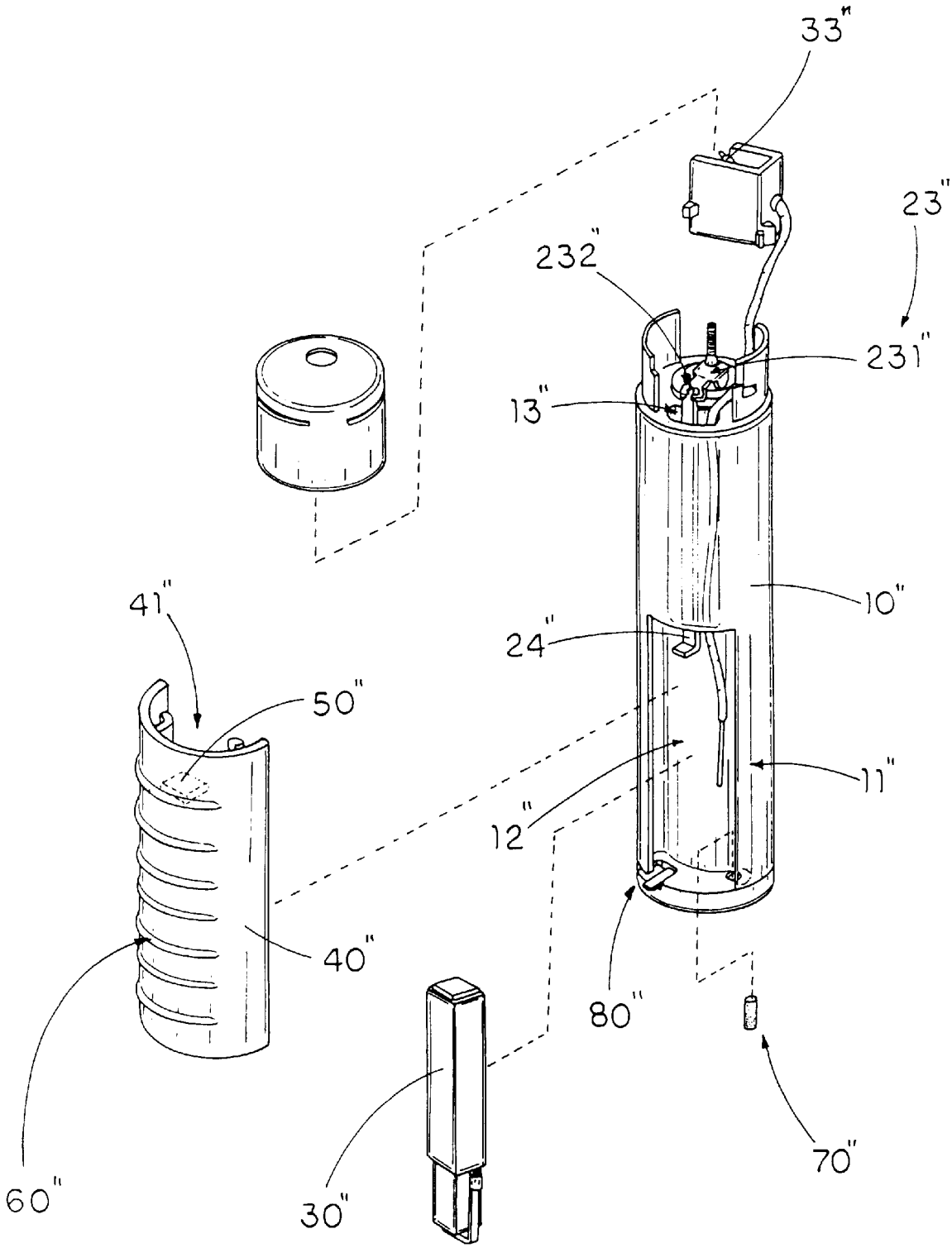
FIG. 7 is an exploded perspective view of a disposable lighter according to a third preferred embodiment of the present invention.

As shown in FIG. 7, a disposable lighter of a third embodiment illustrates an alternative mode of the first and second embodiments, wherein the disposable lighter of the third embodiment basically is a combination of the first and second embodiments.

The gas casing 10" has a receiving chamber 12" provided on a lower portion of the sidewall of the gas casing 10" and a through slot 14" extended from the receiving chamber 12" to a ceiling of the gas casing 10".

The piezoelectric unit 30" is disposed in the receiving chamber 12" within the receiving cavity 41" wherein the spark generating tip 33" is extended from the piezoelectric unit 30" through the through slot 14" to a position close to the ignition tip 21" of the gas emitting nozzle 20".

The outer shelter 40" is shaped and sized to partially cover the sidewall of the gas casing 10" in a slidably movable manner so as to enclose the receiving chamber 12", wherein the outer shelter 40" is adapted to be axially and downwardly slid on the sidewall of the gas casing 10". The actuating arm 50" is extended from the inner side of the outer shelter 40" to a top end of the piezoelectric unit 30" in such a manner that when the outer shelter 40" is axially slid on the gas casing 10", the actuating arm 50" is driven downwardly to compress the piezoelectric unit 30" so as to ignite the disposable lighter.

The gas emitting nozzle 20" further comprises a driven arm 24" having a pulling end engaged with the actuating end 232" of the gas lever 23" and a driven end extended through the through slot 14" to engage with the actuating arm 50" in such a manner that when the outer shelter 40" is axially slid on the gas casing 10", the actuating arm 50" is driven downwardly to lift up the engaging end 231" of the gas lever 23" for releasing the gas from the fuel storage 11".

Without violating the very spirit of present invention, some variations based on the above mentioned embodiments should be considered as equivalence. For example, the disposable lighter can be shaped into any aesthetic appearance wherein the ignition operation thereof requires the outer shelter 40 axially slid on the gas casing 10 to compress the piezoelectric unit 30 and move the gas lever 23 for releasing gas. Moreover, the disposable lighter of the present invention can stop the young children from the usage of the disposable lighter by the limitation of their physical capability and prevent the disposable lighter from being ignited accidentally and unintentionally.

What is claimed is:

1. A disposable lighter, comprising:

a gas casing receiving a fuel storage, wherein said gas casing has a receiving chamber provided on a lower portion of a sidewall of said gas casing and a through slot extended from said receiving chamber to a ceiling of said gas casing;

a gas emitting nozzle having an ignition tip appearing at said ceiling of said gas casing and communicating with said fuel storage for controlling a flow of gas, wherein said gas emitting nozzle further comprises a gas releasable valve and a gas lever having an engaging end engaged with said gas releasable valve and an actuating end arranged in such a manner that when said actuating end of said gas lever is depressed downwardly, said engaging end of said gas lever pivotally lifts up said gas releasable valve to release said gas from said fuel storage through said ignition tip;

a piezoelectric unit comprising a main piezoelectric body, a movable operating part slidably extended therefrom, and a spark generating tip extended to a position close to said ignition tip of said gas emitting nozzle, wherein when said movable operating part is depressed with respect to said main piezoelectric body, said spark generating tip generates sparks to ignite said gas emitted from said ignition tip of said gas emitting nozzle, wherein said piezoelectric unit is received in said receiving chamber and said spark generating tip is extended through said through slot towards said ignition tip of said gas emitting nozzle;

an outer shelter slidably mounted on said sidewall of said gas casing and defining a receiving cavity between said outer shelter and said gas casing wherein said piezoelectric unit is received in said receiving cavity, wherein said outer shelter is constructed as a tubular sleeve having a shape and size encirclingly mounted on a lower portion of said sidewall of said gas casing in an axially and slidably movable manner, so as to enclose said receiving chamber of said gas casing; and an actuating arm extended from an inner side of said outer shelter to a top end of said piezoelectric unit in such a manner that when said outer shelter is axially slid with respect to said gas casing, said actuating arm is driven to compress said piezoelectric unit so as to ignite said disposable lighter.

2. A disposable lighter, as recited in claim 1, wherein said gas emitting nozzle further comprises a driven arm having a pulling end engaged with said actuating end of said gas lever and driven end extended through said through slot to engage with said actuating arm in such a manner that when said outer shelter is axially slid on said gas casing, said actuating arm is driven downwardly to lift up said engaging end of said gas lever through said driven arm for releasing said gas from said fuel storage.

3. A disposable lighter, as recited in claim 2, further comprises a pressure absorbing arrangement which comprises a compression resistance element supported in said receiving cavity for providing a sliding resistance against said outer shelter and a pusher arm extended from said inner side of said outer shelter to a top end of said compression resistance element, wherein said sliding resistance is an additional upward force added to said outer shelter in addition to that provided by said piezoelectric unit.

4. A disposable lighter, as recited in claim 2, further comprising an ignition guiding arrangement which comprises a first guider provided on an outer side of said outer shelter and a second guider provide on an upper portion of an opposed sidewall of said gas casing wherein said first and second guiders provide finger grips for frictionally contacting a user's thumb and finger on said gas casing and said outer shelter respectively so as to slide said outer shelter on said gas casing.

5. A disposable lighter, as recited in claim 3, further comprising an ignition guiding arrangement which comprises a first guider provided on an outer side of said outer shelter and a second guider provide on an upper portion of an opposed sidewall of said gas casing wherein said first and second guiders provide finger grips for frictionally contacting a user's thumb and finger on said gas casing and said outer shelter respectively so as to slide said outer shelter on said gas casing.

6. A disposable lighter, as recited in claim 2, further comprising a safety locking arrangement for locking a sliding movement of said outer shelter on said gas casing, wherein said safety locking arrangement has a locking groove transversely provided on said inner side of said outer shelter and comprises a locking member having a control end rotatably mounted to said gas casing and a locking end adapted to move into said locking groove so as to lock up said outer shelter on said gas casing.

7. A disposable lighter, as recited in claim 2, further comprising a safety locking arrangement for locking a sliding movement of said outer shelter on said gas casing, wherein said safety locking arrangement has a locking groove transversely provided on said sidewall of said gas casing and a locking hole provide on said outer shelter and aligned with said locking groove, said safety locking arrangement further comprising a locking member slidably received in said locking groove, a resilient element disposed in said locking groove for applying an urging force against said locking member to push said locking member towards said locking hole to lock up said outer shelter on said gas casing, and a pusher button slidably mounted on said outer shelter through said locking hole and arranged in such a manner that when said pusher button pushes said locking member into said locking groove, said locking member is moved out of said locking hole to release a blocking up of said outer shelter with respect to said gas casing, so that said outer shelter is capable of axially sliding on said gas casing.

8. A disposable lighter, comprising:

a gas casing receiving a fuel storage, Wherein said gas casing further has a receiving chamber formed on a lower portion of a sidewall of said gas casing and a guiding slot which is indented on said sidewall of said gas casing and extended from said receiving chamber to a ceiling of said gas casing;

a gas emitting nozzle having an ignition tip appearing at said ceiling of said gas casing and communicating with said fuel storage for controlling a flow of gas, wherein said gas emitting nozzle further comprises a gas releasable valve and a gas lever having an engaging end engaged with said gas releasable valve and an actuating end arranged in such a manner that when said actuating end of said gas lever is depressed downwardly, said engaging end of said gas lever pivotally lifts up said gas releasable valve to release said gas from said fuel storage through said ignition tip;

a piezoelectric unit comprising a main piezoelectric body, a movable operating part slidably extended therefrom, and a spark generating tip extended to a position close to said ignition tip of said gas emitting nozzle, wherein when said movable operating part is depressed with respect to said main piezoelectric body, said spark generating tip generates sparks to ignite said gas emitted from said ignition tip of said gas emitting nozzle, wherein said piezoelectric unit is disposed in said receiving chamber and said spark generating tip is guided to extend towards said ignition tip of said gas emitting nozzle through said guiding slot;

an outer shelter slidably mounted on said sidewall of said gas casing and defining a receiving cavity between said outer shelter and said gas casing wherein said piezoelectric unit is received in said receiving cavity, wherein said outer shelter is shaped and sized to cover said sidewall of said gas casing in a slidably movable manner so as to enclose said receiving chamber and retain said piezoelectric unit in position;

an actuating arm extended from an inner side of said outer shelter to a top end of said piezoelectric unit in such a manner that when said outer shelter is axially slid with respect to said casing, said actuating arm is driven to compress said piezoelectric unit so as to ignite said disposable lighter;

a depressible arm extended from said inner side of said outer shelter to engage with said actuating end of said gas lever in such a manner that when said outer shelter is axially slid on said gas casing, said depressible arm is driven downwardly to depress said actuating end of said gas lever, so as to lift up said gas releasable valve for releasing said gas from said fuel storage; and a safety locking arrangement for locking a sliding movement of said outer shelter on said gas casing, wherein said safety locking arrangement has a locking groove transversely provided on said inner side of said outer shelter and comprises a locking member having a control end rotatably mounted to said gas casing and a locking end adapted to move into said locking groove so as to lock up said outer shelter on said gas casing.

9. A disposable lighter, comprising:

a gas casing receiving a fuel storage, wherein said gas casing further has a receiving chamber formed on a lower portion of a sidewall of said gas casing and a guiding slot which is indented on said sidewall of said gas casing and extended from said receiving chamber to a ceiling of said gas casing;

a gas emitting nozzle having an ignition tip appearing at said ceiling of said gas casing and communicating with said fuel storage for controlling a flow of gas, wherein said gas emitting nozzle further comprises a gas releasable valve and a gas lever having an engaging end engaged with said gas releasable valve and an actuating end arranged in such a manner that when said actuating end of said gas lever is depressed downwardly, said engaging end of said gas lever pivotally lifts up said gas releasable valve to release said gas from said fuel storage through said ignition tip;

a piezoelectric unit comprising a main piezoelectric body, a movable operating part slidably extended therefrom, and a spark generating tip extended to a position close to said ignition tip of said gas emitting nozzle, wherein when said movable operating part is depressed with respect to said main piezoelectric body, said spark generating tip generates sparks to ignite said gas emitted from said ignition tip of said gas emitting nozzle, wherein said piezoelectric unit is disposed in said receiving chamber and said spark generating tip is guided to extend towards said ignition tip of said gas emitting nozzle through said guiding slot;

an outer shelter slidably mounted on said sidewall of said gas casing and defining a receiving cavity between said outer shelter and said gas casing wherein said piezoelectric unit is received in said receiving cavity, wherein said outer shelter is shaped and sized to cover said sidewall of said gas casing in a slidably movable manner so as to enclose said receiving chamber and retain said piezoelectric unit in position;

an actuating arm extended from an inner side of said outer shelter to a top end of said piezoelectric unit in such a manner that when said outer shelter is axially slid with respect to said gas casing, said actuating arm is driven to compress said piezoelectric unit so as to ignite said disposable lighter;

a depressible arm extended from said inner side of said outer shelter to engage with said actuating end of said gas lever in such a manner that when said outer shelter is axially slid on said gas casing, said depressible arm is driven downwardly to depress said actuating end of said gas lever, so as to lift up said gas releasable valve for releasing said gas from said fuel storage; and a safety locking arrangement for locking a sliding movement of said outer shelter on said gas casing, wherein said safety locking arrangement has a locking groove transversely provided on said sidewall of said gas casing and a locking hole provide on said outer shelter and aligned with said locking groove, said safety locking arrangement further comprising a locking member slidably received in said locking groove, a resilient element disposed in said locking groove for applying an urging force against said locking member to push said locking member towards said locking hole to lock up said outer shelter on said gas casing, and a pusher button slidably mounted on said outer shelter through said locking hole and arranged in such a manner that when said pusher button pushes said locking member into said locking groove, said locking member is moved out of said locking hole to release a blocking up of said outer shelter with respect to said gas casing, so that said outer shelter is capable of axially sliding on said gas casing.

* * * * *